US010135164B1

(12) United States Patent
Shih

(10) Patent No.: US 10,135,164 B1
(45) Date of Patent: Nov. 20, 2018

(54) ELECTRICAL CONNECTOR WITH ADJUSTABLE INSERTION HEIGHT AND ORIENTATIONS

(71) Applicant: PHIHONG TECHNOLOGY CO., LTD., Taoyuan (TW)

(72) Inventor: Chia Wei Shih, Taoyuan (TW)

(73) Assignee: PHIHONG TECHNOLOGY CO., LTD., Taoyuan (TW)

( * ) Notice: Subject to any disclaimer, the term of this patent is extended or adjusted under 35 U.S.C. 154(b) by 0 days.

(21) Appl. No.: 15/693,505

(22) Filed: Sep. 1, 2017

(30) Foreign Application Priority Data

Aug. 1, 2017 (TW) ..... 106125924 A

(51) Int. Cl.

| | |
|---|---|
| ***H01R 12/00*** | (2006.01) |
| ***H01R 12/71*** | (2011.01) |
| ***H01R 12/70*** | (2011.01) |
| ***H01R 12/52*** | (2011.01) |
| ***H01R 13/42*** | (2006.01) |
| ***H01R 13/52*** | (2006.01) |
| ***H01R 13/04*** | (2006.01) |

(52) U.S. Cl.
CPC ..... *H01R 12/716* (2013.01); *H01R 12/523* (2013.01); *H01R 12/7064* (2013.01); *H01R 12/7088* (2013.01); *H01R 13/04* (2013.01); *H01R 13/42* (2013.01); *H01R 13/5202* (2013.01)

(58) Field of Classification Search
CPC ..... H01R 9/096; H01R 12/52; H01R 13/518; H01R 13/659; H01R 27/02
USPC ..... 439/65, 541.5
See application file for complete search history.

(56) References Cited

U.S. PATENT DOCUMENTS

| | | | | |
|---|---|---|---|---|
| 5,382,168 A * | 1/1995 | Azuma | H01R 12/716 | 439/571 |
| 8,011,930 B2 * | 9/2011 | Lee | H01R 13/6675 | 439/18 |
| 8,100,699 B1 * | 1/2012 | Costello | H01R 12/7082 | 439/541.5 |
| 8,272,899 B2 * | 9/2012 | Youssefi-Shams | H01R 13/44 | 439/628 |
| 9,004,938 B2 * | 4/2015 | Chang | H01R 12/50 | 439/541.5 |

(Continued)

*Primary Examiner* — Hae Moon Hyeon
(74) *Attorney, Agent, or Firm* — Chih Feng Yeh; Huntington IP Consulting Co., Ltd.

(57) ABSTRACT

An electrical connector with adjustable insertion height and orientations includes a first circuit board, an insulating base with a plurality of conduction terminals electrically connected to the first circuit board, a USB type-C connector been set on the insulating base having an opening and twenty-four connection terminals, and a second circuit board with twenty-four connection terminals and a plurality of transferring terminals for electrically connecting to the USB type-C connector and the insulating base, wherein the height of the insulating base with respective to the first circuit board can be adjusted. The height of the USB type-C connector with respective to the first circuit board therefore can be adjusted. The relative orientation between the opening of the mentioned USB type-C and the normal of the first circuit board plane also can be adjusted through re-arranging the configuration of the plurality of conduction terminals on the insulating base.

20 Claims, 6 Drawing Sheets

(56) References Cited

U.S. PATENT DOCUMENTS

| | | | | |
|---|---|---|---|---|
| 9,024,581 | B2 * | 5/2015 | McGinley | H02J 7/0042 320/111 |
| 9,276,340 | B2 * | 3/2016 | Amini | H01R 12/71 |
| 9,685,718 | B1 * | 6/2017 | Wang | H01R 12/52 |
| 9,722,374 | B2 * | 8/2017 | Hsu | H01R 27/02 |
| 2013/0210271 | A1 * | 8/2013 | Chang | H01R 13/518 439/535 |
| 2015/0091380 | A1 * | 4/2015 | Chang | H01R 27/02 307/23 |
| 2015/0380862 | A1 * | 12/2015 | Song | H01R 13/5202 439/559 |
| 2016/0043484 | A1 * | 2/2016 | Brodsky | H01R 12/716 439/65 |
| 2016/0359284 | A1 * | 12/2016 | Hsu | H01R 27/02 |
| 2016/0372850 | A1 * | 12/2016 | Tsai | H01R 12/724 |

* cited by examiner

ELECTRICAL CONNECTOR WITH ADJUSTABLE INSERTION HEIGHT AND ORIENTATIONS

BACKGROUND OF THE INVENTION

Field of the Invention

The present invention relates to an electrical connector, and more particularly, an electrical connector with adjustable height and orientations.

Description of Related Art

In nowadays, 3C electronic products are popular and people utilizes them in various kind of activities in daily life. In order to transmit control commands, data, multimedia, and power between electronic devices. Most electronic devices are equipped at least one electrical connector for handling the mentioned functions. Generally, an universal serial bus (USB) connector is the most common connector. There exists various kind of USB connectors, USB Type-A is the most popular one. USB micro-B is a different kind of connector which is smaller than the USB Type-A, and is mostly utilized in portable devices such as smart phones, tablets, etc. Recently, the USB development organization developed a new type USB Type-C interface, the USB Type-C specification 1.0 was announced by USB Implements Forum (USB-IF) and was finalized in August 2014.

USB type-C is a new, tiny, super-fast connector for the Universal Serial Bus standard that can support a number of new standards including USB3.1 and USB power delivery. At a mere 0.33×0.1 inches (8.4×2.6 mm), Type-C has twenty-four conduction terminals for delivering data and power. Uniquely, USB Type-C is reversible, it has horizontally symmetrical structure, meaning user can plug it in upside down and it will still work. Compared with USB micro-B, the user of the USB Type-C connector has not necessary to distinguish which side to be connected to, because it is totally symmetrical. The connector provides four power/ground pairs, two differential pairs for non-SuperSpeed data (though only one pair is populated in a USB-C cable), four pairs for SuperSpeed data bus (only two pairs are used in USB 3.1 mode), two "sideband use" pins, $V_{CONN}$+5 V power for active cables, and a configuration pin used for cable orientation detection and dedicated biphase mark code (BMC) configuration data channel. USB Type-C connector has other characteristics such as charging other 3C electronic products by the USB power delivery technology, improving anti-electromagnetic interference (anti-EMI) and radio frequency interference (RFI) mitigation, supporting more than ten thousand times plug-unplug, and supporting DisplayPort for connecting to high definition multimedia interface (HDMI) screen and audio speaker. These characteristics provided by the USB Type-C connector will be adaptive to electronic products in a variety of application fields, particularly in the power supply connector interface.

Limited by the manufacture process of electrical connector, the height of the connector will also be restrained. However, occasionally, the exterior position of the connector (port position) needs to be adjusted to fit into client's specification based on their design, the structure of the connector could become more complicated in order to accommodating client's requests. In addition, the certification process of USB Type-C connector follows the rule of one thing one material, any material change or modification of manufacture process will cause the original certification no longer valid, a new certification process should be proceeded. This means a modification of the USB Type-C existing connector will have extra cost from the certification process.

In order to overcome the disadvantages mentioned above, an alternative solution needs to be provided.

SUMMARY OF THE INVENTION

In this invention, an electrical connector with adjustable height and orientation is proposed. An electrical connector with adjustable insertion height and orientation. In one of the exemplary embodiments, the electrical connector comprises a first circuit board, an insulating base with a plurality of conduction terminals electrically connected to the first circuit board, an USB type-C connector been set on the insulating base having an opening and a plurality of connection terminals, and a second circuit board with a plurality of connection terminals and a plurality of transferring terminals for electrically connecting to the USB type-C connector and the insulating base. The height of the insulating base with respective to the first circuit board can be adjusted, the height of the USB type-C connector with respective to the first circuit board therefore can be adjusted, and the relative orientation between the opening of the mentioned USB type-C and the normal of the first circuit board plane also can be adjusted through re-arranging the configuration of the plurality of conduction terminals on the insulating base.

According to one aspect of the invention, the first circuit board is a printed circuit board assembly (PCBA).

According to one aspect of the invention, the second circuit board is a printed circuit board assembly (PCBA).

The second circuit board further comprises a connection circuit electrically connecting the twenty-four connection terminals and the plurality of transferring terminals for integrating the USB type-C connector through the output signals of the twenty-four connection terminals and outputting the signals through the plurality of transferring terminals According to one aspect of the invention, the opening of the USB type-C connector can be parallel or orthogonal to the normal of the second circuit board.

According to another aspect of the invention, the USB type-C connector further comprises a cover with a plurality of metal reeds.

The second circuit board further comprises a plurality of slots corresponding to the plurality of metal reeds on the USB type-C connector for latching the USB type-C connector onto the second circuit board.

The insulating base further comprises an opening for accommodating the USB type-C connector and a plurality of conduction terminals each terminal with two ends sticking out of the surfaces of the insulating base, the plurality of conduction terminals each terminal with two ends can respectively sticking out of the two adjacent or two opposite surfaces of the insulating base.

The USB type-C connector further comprises an insulating waterproof ring for preventing water and dust entering from outside environment.

BRIEF DESCRIPTION OF THE DRAWINGS

The components, characteristics and advantages of the present invention may be understood by the detailed descriptions of the preferred embodiments outlined in the specification and the drawings attached.

DETAILED DESCRIPTION

Some preferred embodiments of the present invention will now be described in greater detail. However, it should be recognized that the preferred embodiments of the present invention are provided for illustration rather than limiting the present invention. In addition, the present invention can be practiced in a wide range of other embodiments besides those explicitly described, and the scope of the present invention is not expressly limited except as specified in the accompanying claims.

For offering an electrical connector with adjustable insertion height and orientation for design flexibility, this invention provides a base with various heights for adjusting connector's height and also adopts a design for changing the insertion orientation by rotating the connector 90 degrees. The present invention provides a base or an adaptor with adjustable insertion height and orientation, it will offer a design flexibility in 3C electronic products equipped with USB Type-C connector preventing complex structure design. In addition, this invention also offer a waterproof design which enhances the value and reliability of electronic products.

Figure 1A:
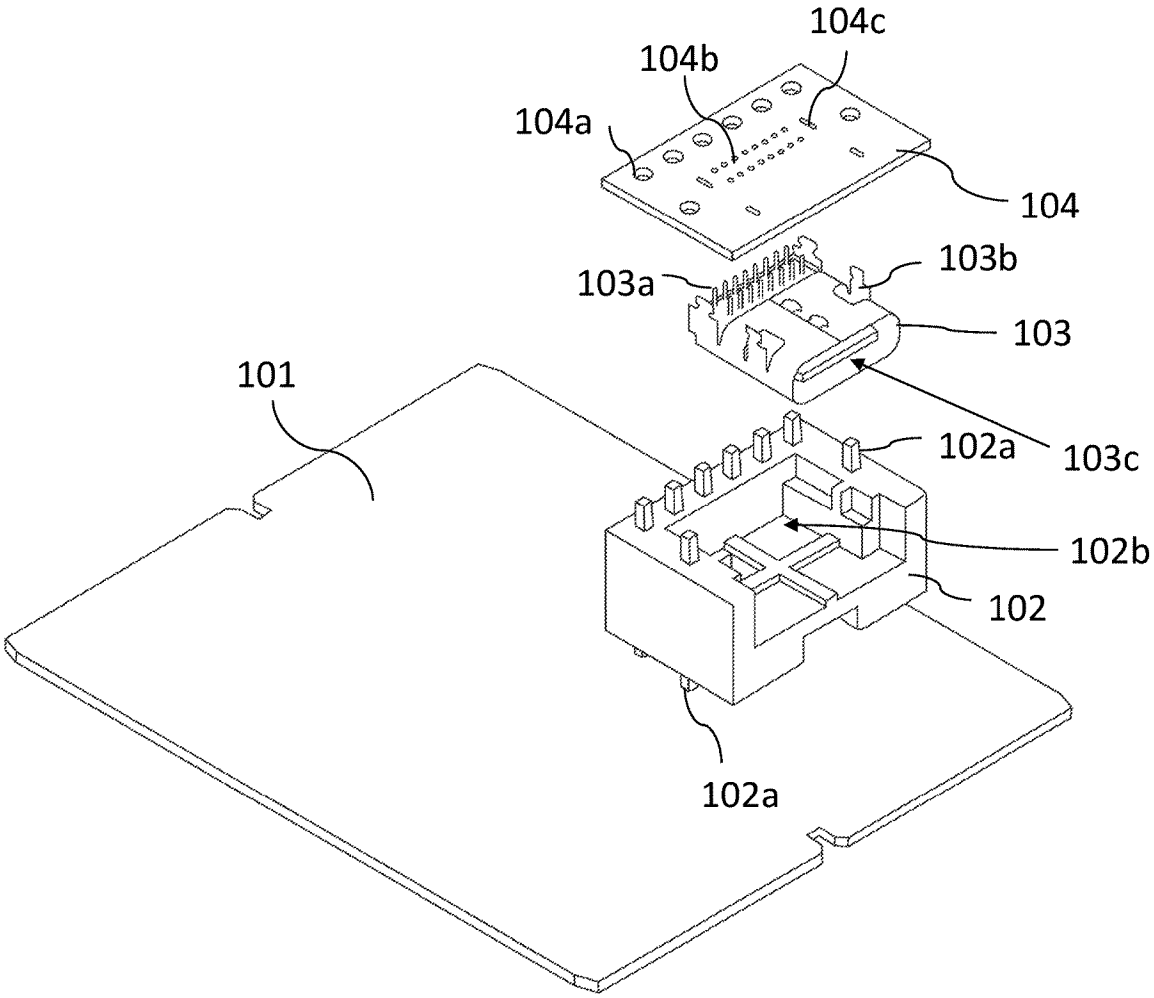
FIG. 1A illustrates an exploded view of an electrical connector with adjustable insertion height and orientation according to an embodiment of the invention.

According to the mentioned concept, FIG. 1A illustrates an exploded view of an electrical connector with adjustable insertion height and orientation according to an embodiment of the invention. As shown in FIG. 1A, the present invention provides a base 102 with an opening 102*b* for accommodating an USB Type-C connector 103 into, the base 102 can electrically connect to a first printed circuit board assembly (PCBA) 101 circuit board and a second printed circuit board assembly (PCBA) 104 through a plurality of conduction terminals 102*a* where each terminal has two ends stick out of the top and down surfaces of the base 102 respectively. The USB Type-C connector 103 has an opening 103*c*. Its cover having a plurality of (at least sixteen) conduction terminals 103*a* is electrically connected to the corresponding plurality of conduction points 104*b* and having a plurality of metal reeds 103*b* latches into the corresponding slots 104*c* of the second printed circuit board assembly (PCBA) 104, respectively. The second printed circuit board assembly (PCBA) 104 can act as a transfer terminal and can electrically connect to the first printed circuit board assembly (PCBA) 101 through a plurality of conduction points 104*a* (match the conduction terminals 102*a* of the base). The second printed circuit board assembly (PCBA) 104 contains a connection circuit (not shown) electrically connected to the plurality of conduction points 104*b* and the plurality of transferring terminals (conduction points) 104*a* for integrating the USB type-C connector 103 through the output signals of the plurality of conduction terminals 103*a* and outputs the signals through the plurality of transferring terminals (conduction points) 104*a*. Therefore, the USB type-C connector 103 can electrically connect to the first printed circuit board assembly (PCBA) 101, through the transferring function of the second printed circuit board assembly (PCBA) 104, and eventually electrically couple to other electrical connectors, for example, an USB Type-A connector, etc.

Figure 1B:
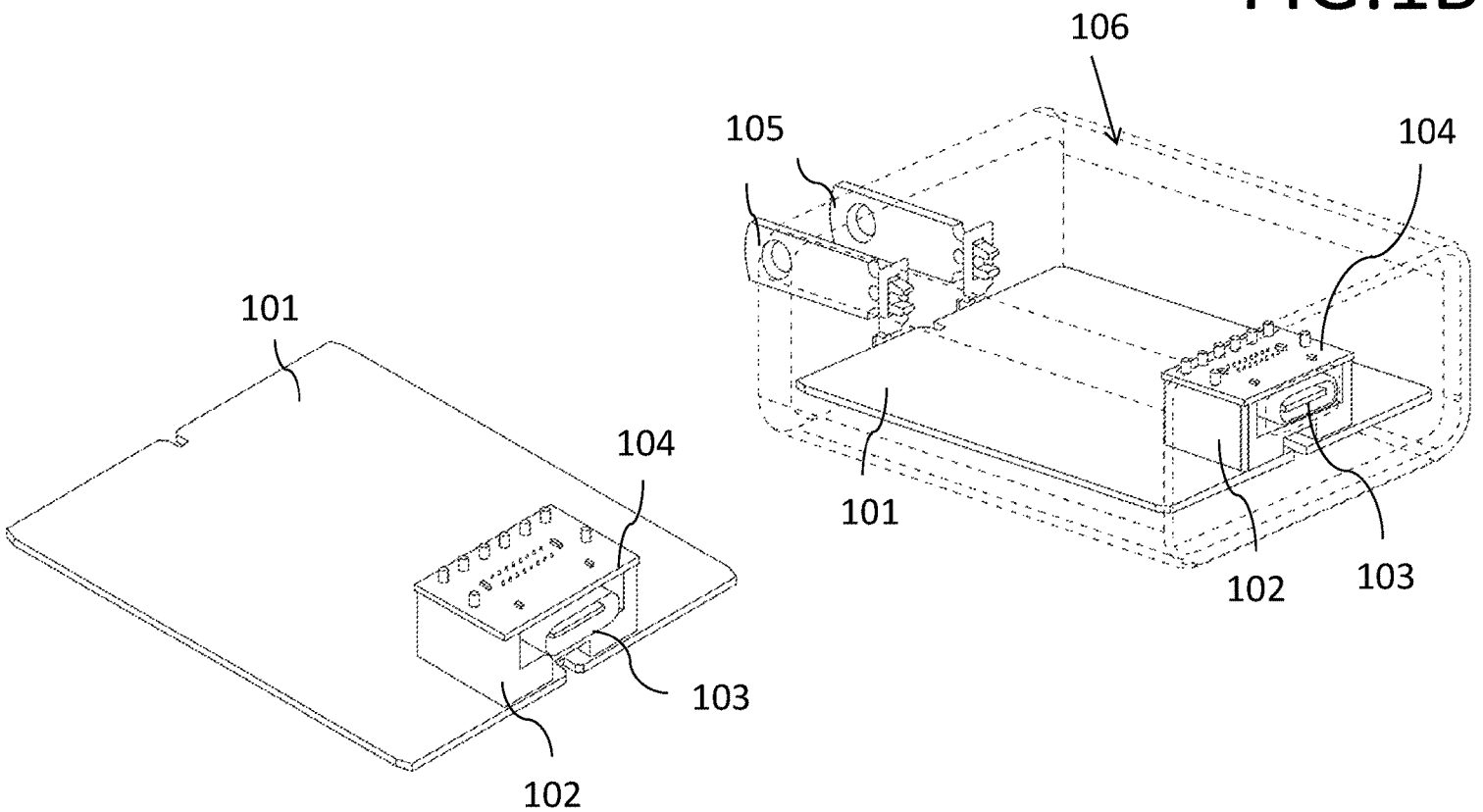
FIG. 1B illustrates a perspective view of an electrical connector with adjustable insertion height and orientation according to an embodiment of the invention.

FIG. 1B illustrates a perspective view of an electrical connector with adjustable insertion height and orientation according to an embodiment of the invention. Referring to FIG. 1B, the figure in the left illustrates an assembly of an electrical connector containing an USB Type-C connector 103 accommodated on the base 102, electrically integrating with a second printed circuit board assembly (PCBA) 104, and inserted onto a first printed circuit board assembly (PCBA) 101 directly with electrical connection; the figure in the right illustrates an assembly of a power charger which is assembled by integrating the previous mentioned electrical connector assembly with an AC power plug 105 and an insulating cover 106.

Figure 2:
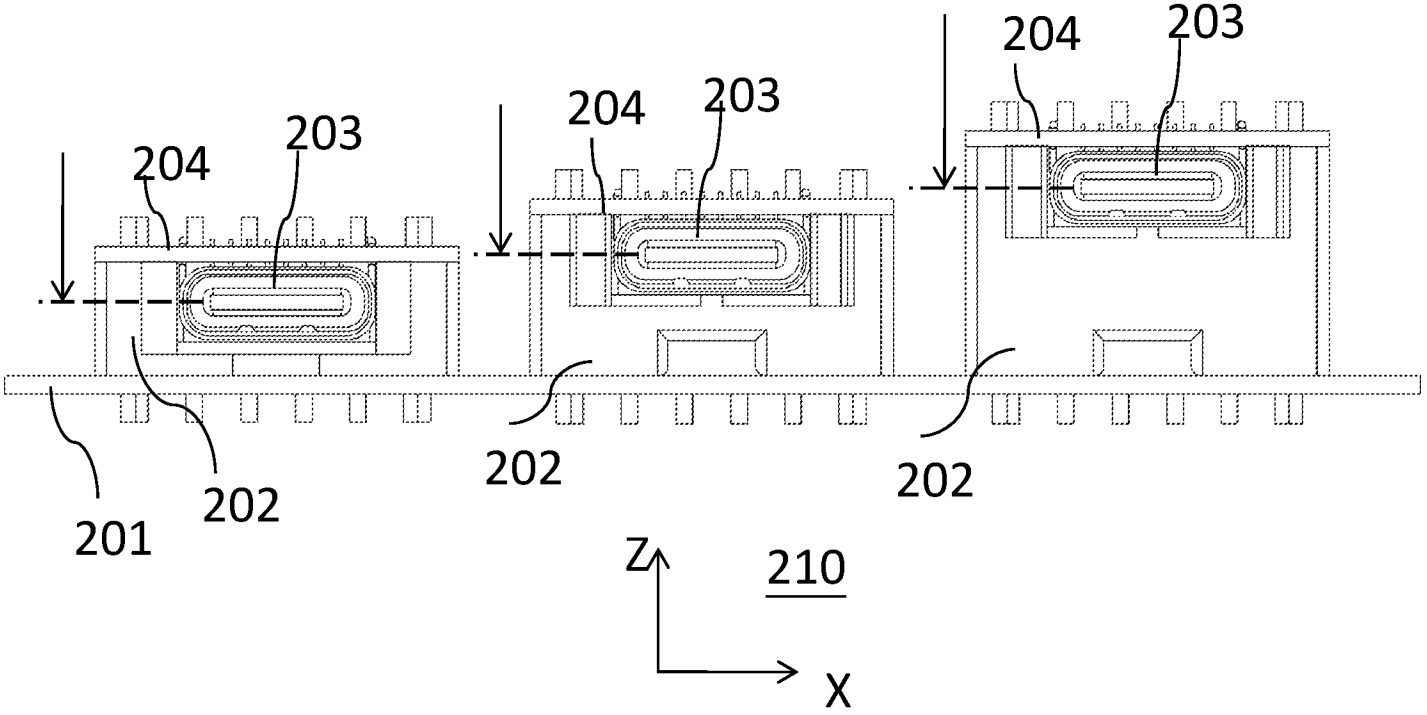
FIG. 2 illustrates a perspective view showing an electrical connector with adjustable insertion height according to an embodiment of the invention.

FIG. 2 illustrates a perspective view showing an electrical connector with adjustable insertion height according to an embodiment of the invention. Referring to FIG. 2, it illustrates an assembly of the electrical connector containing an USB Type-C connector 203, a first printed circuit board assembly (PCBA) 201, and a second printed circuit board assembly (PCBA) 204 assembled on an insulating base 202 with various heights. The height of the insulating base 202 determines the plug location of the connector indicated by the arrows and dashed lines. An orthogonal coordinate system 210 is defined by the width (X), length (Y), and height (Z) of the insulating base 202.

Figure 3:
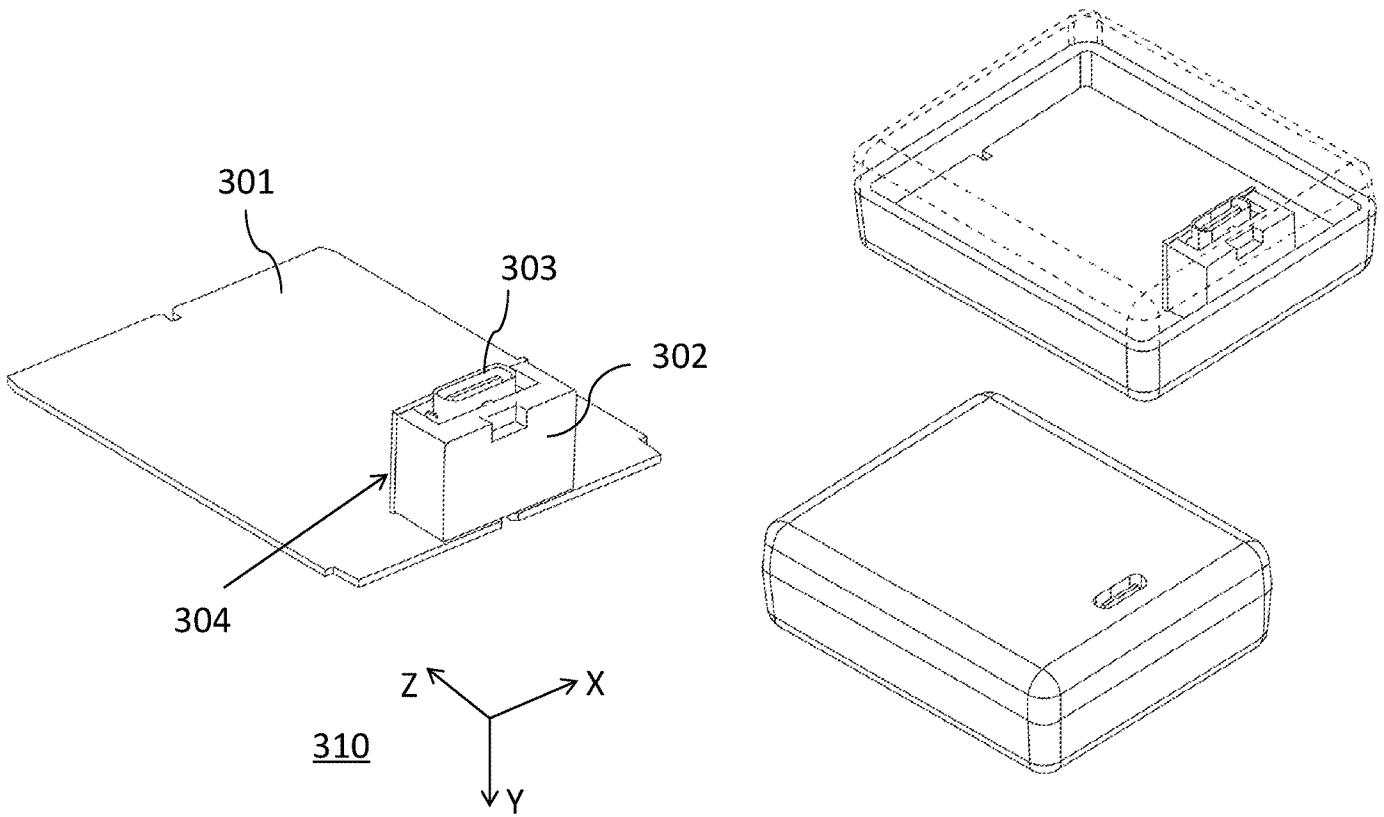
FIG. 3 illustrates a perspective view showing an electrical connector with adjustable insertion orientation according to an embodiment of the invention.

FIG. 3 illustrates a perspective view showing an electrical connector with adjustable insertion orientations according to an embodiment of the invention. Referring to FIG. 3, the figure in the left illustrates an assembly of the electrical connector, containing an USB Type-C connector 303 and a second printed circuit board assembly (PCBA) 304 integrated with an insulating base 302, and then assembled onto a first printed circuit board assembly (PCBA) 301. A coordinate system 310 is defined by the width (X), length (Y), and height (Z) of the insulating base 302, which is an new orthogonal coordinate system by rotating 90 degree with respective to X axis in the old orthogonal coordinate system 210 shown in FIG. 2. In one of the exemplary embodiments, the configuration of the base's conduction terminals is modified by re-arranging the exposed two ends of each terminal letting one end still sticking out of the base's surface in the Z direction and makes the USB Type-C connector electrically connected and structurally latched to the second PCBA 304. On the other hand, another end of the terminals (please referring element 102*a* in FIG. 1A) rotates 90 degrees sticking out of the base's surface in the Y direction and makes the assembly electrically connected and inserted onto the first PCBA 301 directly. Referring to FIG. 3, the figures in the right demonstrate the mentioned electrical connector assembly with an opening of the USB Type-C connector facing upward.

Figure 4:
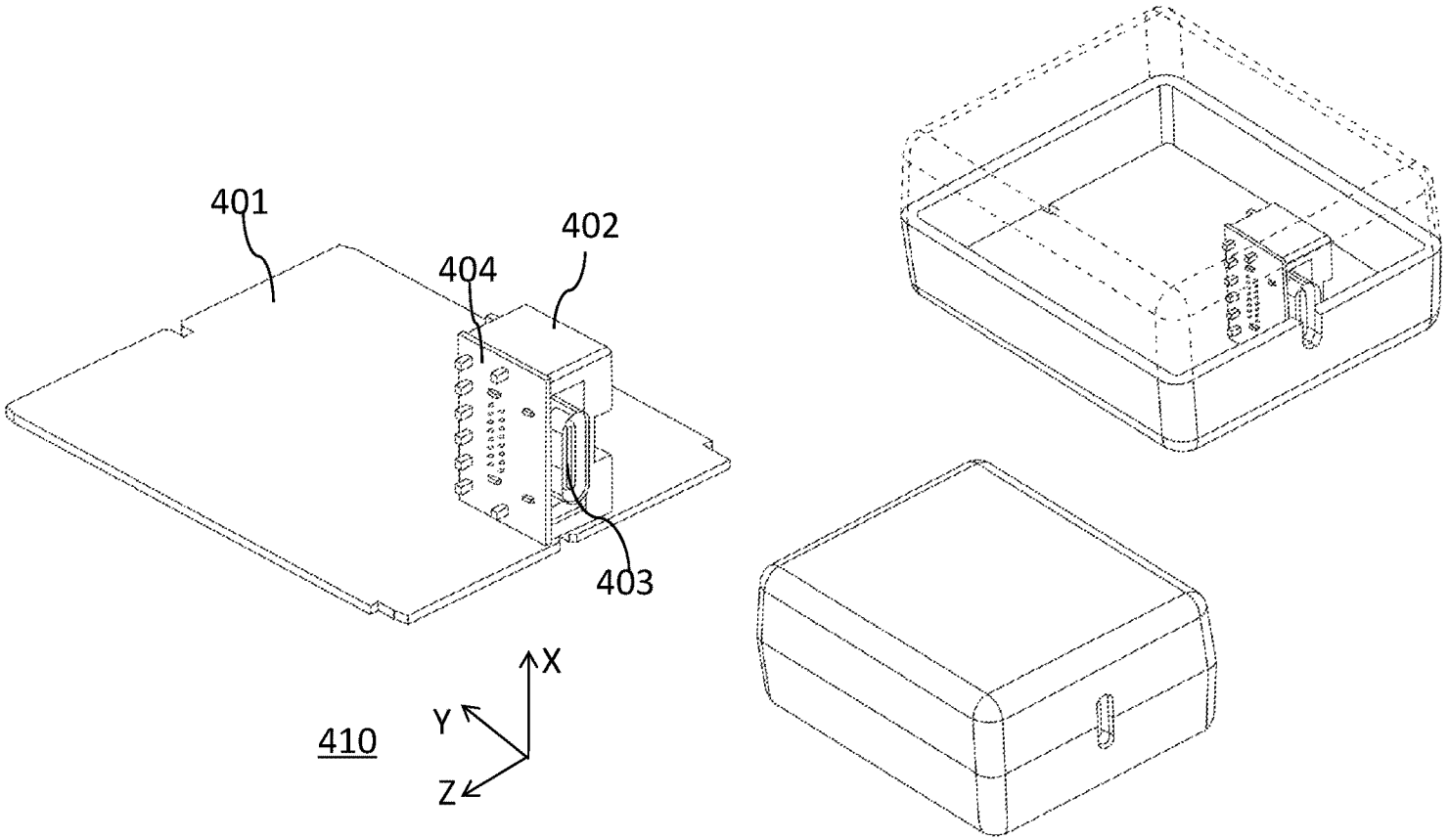
FIG. 4 illustrates a perspective view showing an electrical connector with adjustable insertion orientation according to another embodiment of the invention.

FIG. 4 illustrates a perspective view showing an electrical connector with adjustable insertion orientation according to another embodiment of the invention. As shown in FIG. 4, the figure in the left illustrates an assembly of the electrical connector, containing an USB Type-C connector 403 and a second printed circuit board assembly (PCBA) 404 integrated with an insulating base 402, and then assembled onto a first printed circuit board assembly (PCBA) 401. A coordinate system 410 is defined by the width (X), length (Y), and height (Z) of the insulating base 402, which is an new orthogonal coordinate system by rotating 90 degree with respective to Y axis in the old orthogonal coordinate system 210 shown in FIG. 2. In one of the exemplary embodiments, the configuration of the base's conduction terminals is modified by re-arranging the exposed two ends of each terminal letting one end still sticking out of the base's surfaces in the Z direction and makes the USB Type-C connector electrically connected and structurally latched to the second PCBA 404. On the other hand, another end of the terminals (please referring element 102*a* in FIG. 1A) rotates 90 degrees sticking out of the base's surface in the X direction and makes the assembly electrically connected and inserted onto the first PCBA 401 directly. Referring to FIG. 4, the figures in the right demonstrate the mentioned assembly with an opening of the USB Type-C connector facing forward.

Figure 5:
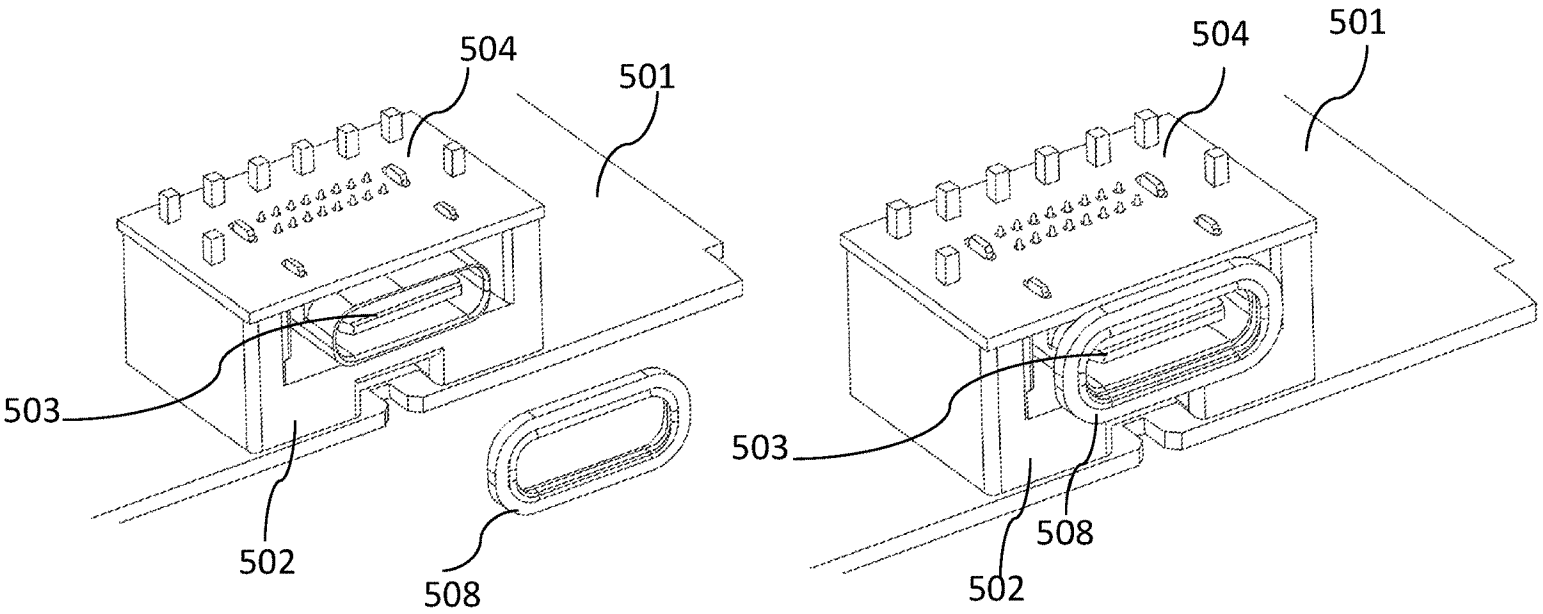
FIG. 5 illustrates a prospective view showing an electrical connector with waterproof function according to an embodiment of the invention.

FIG. 5 illustrates a prospective view showing an electrical connector with waterproof function according to an embodiment of the invention. As shown in FIG. 5, an electrical connector assembly contains an USB Type-C connector 503 and a second PCBA 504 integrated with an insulating base 502, and then assembled onto a first PCBA 501. The USB connector port itself has seal design for waterproof and dustproof, but the joint interface between the connector and the assembled parts are the potential weak places for leakage. More importantly, the joint interface between the connector and a chassis. In the present invention, an insulating rubber ring 508 which provides an ingress protection up to level IP67 for offering the highest level of waterproof and dustproof protection. With this kind of protection, electronic products can sustain in one meter deep water for 30 minutes.

The present invention has the features and advantages:

(1) the structure design includes USB port height adjustment and orientation adjustment which can provide flexible design requirements in a variety of electronic products.

(2) the waterproof design enhances the value and reliability of electronic products.

As will be understood by persons skilled in the art, the foregoing preferred embodiment of the present invention illustrates the present invention rather than limiting the present invention. Having described the invention in connection with a preferred embodiment, modifications will be suggested to those skilled in the art. Thus, the invention is not to be limited to this embodiment, but rather the invention is intended to cover various modifications and similar arrangements included within the spirit and scope of the appended claims, the scope of which should be accorded the broadest interpretation, thereby encompassing all such modifications and similar structures. While the preferred embodiment of the invention has been illustrated and described, it will be appreciated that various changes can be made without departing from the spirit and scope of the invention.

What is claimed is:

1. An electrical connector with adjustable insertion height and orientations, comprising:

a first circuit board;

an insulating base with an opening and a plurality of conduction terminals electrically connected to the first circuit board;

a USB type-C connector having an opening and a plurality of connection terminals been accommodated into the opening of the insulating base; and a second circuit board with a plurality of connection terminals electrically connecting to the USB type-C connector and a plurality of transferring terminals electrically connecting to the insulating base, wherein the height of the insulating base with respective to the first circuit board can be adjusted, the height of the USB type-C connector with respective to the first circuit board therefore can be adjusted, and the relative orientation between the opening of the mentioned USB type-C connector and the normal of the first circuit board plane also can be adjusted through re-arranging the configuration of the plurality of conduction terminals on the insulating base.

2. The electrical connector of claim 1, wherein the first circuit board is a printed circuit board assembly (PCBA).

3. The electrical connector of claim 1, wherein the second circuit board is a printed circuit board assembly (PCBA).

4. The electrical connector of claim 1, wherein the second circuit board further comprising a connection circuit electrically connecting the plurality of connection terminals and the plurality of transferring terminals for integrating the USB type-C connector through the output signals of the plurality of connection terminals and outputting the signals through the plurality of transferring terminals.

5. The electrical connector of claim 1, wherein the opening of the USB type-C connector can be parallel or orthogonal to the normal of the second circuit board.

6. The electrical connector of claim 1, wherein the USB type-C connector further comprising a cover with a plurality of metal reeds.

7. The electrical connector of claim 1, wherein the second circuit board further comprising a plurality of slots corresponding to the plurality of metal reeds on the USB type-C connector for latching the USB type-C connector onto the second circuit board.

8. The electrical connector of claim 1, wherein the plurality of conduction terminals of the insulating base:

each of the conduction terminal with two ends is sticking out of the surfaces of the insulating base.

9. The electrical connector of claim 8, wherein each of the conduction terminal with two ends can respectively stick out of the two adjacent or two opposite surfaces of the insulating base.

10. The electrical connector of claim 1, wherein the USB type-C connector further comprising an insulating waterproof ring being coupled to the joint interface between the USB type-C connector and the insulating base for preventing water and dust entering from outside environment.

11. An electrical connector with adjustable insertion height and orientations, comprising:

an AC power plug;

a first circuit board, electrically connected to the AC power plug;

an insulating base with an opening and a plurality of conduction terminals electrically connected to the first circuit board;

a USB type-C connector having an opening and a plurality of connection terminals been accommodated into the opening of the insulating base;

a second circuit board having a plurality of connection terminals electrically connecting to the USB type-C connector and a plurality of transferring terminals electrically connecting to the insulating base, wherein the height of the insulating base with respective to the first circuit board can be adjusted, the height of the USB type-C connector with respective to the first circuit board therefore can be adjusted, and the relative orientation between the opening of the mentioned USB type-C connector and the normal of the first circuit board plane also can be adjusted through re-arranging the configuration of the plurality of conduction terminals on the insulating base; and an insulating cover for housing the AC power plug, the first circuit board, the insulating base, the USB type-C connector, and the second circuit board.

12. The electrical connector of claim 11, wherein the first circuit board is a printed circuit board assembly (PCBA).

13. The electrical connector of claim 11, wherein the second circuit board is a printed circuit board assembly (PCBA).

14. The electrical connector of claim 11, wherein the second circuit board further comprising a connection circuit electrically connecting the plurality of connection terminals and the plurality of transferring terminals for integrating the USB type-C connector through the output signals of the plurality of connection terminals and outputting the signals through the plurality of transferring terminals.

15. The electrical connector of claim 11, wherein the opening of the USB type-C connector can be parallel or orthogonal to the normal of the second circuit board.

16. The electrical connector of claim 11, wherein the USB type-C connector further comprising a cover with a plurality of metal reeds.

17. The electrical connector of claim 11, wherein the second circuit board further comprising a plurality of slots corresponding to the plurality of metal reeds on the USB type-C connector for latching the USB type-C connector onto the second circuit board.

18. The electrical connector of claim 11, wherein the plurality of conduction terminals of the insulating base:

each of the conduction terminal with two ends is sticking out of the surfaces of the insulating base.

19. The electrical connector of claim 18, wherein each of the conduction terminal with two ends can respectively stick out of the two adjacent or two opposite surfaces of the insulating base.

20. The electrical connector of claim 11, wherein the USB type-C connector further comprising an insulating waterproof ring being coupled to the joint interface between the USB type-C connector and the insulating base for preventing water and dust entering from outside environment.

* * * * *